US008971757B2

(12) United States Patent
Okabe et al.

(10) Patent No.: US 8,971,757 B2
(45) Date of Patent: Mar. 3, 2015

(54) IMAGE FORMING DEVICE

(75) Inventors: Yasushi Okabe, Nagoya (JP); Atsushi Kato, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/492,987

(22) Filed: Jun. 11, 2012

(65) Prior Publication Data

US 2012/0263493 A1 Oct. 18, 2012

Related U.S. Application Data

(63) Continuation of application No. 11/391,253, filed on Mar. 29, 2006, now Pat. No. 8,200,119.

(30) Foreign Application Priority Data

Mar. 30, 2005 (JP) ..... 2005-098877

(51) Int. Cl.

| | |
|---|---|
| ***G03G 15/00*** | (2006.01) |
| ***B41J 2/47*** | (2006.01) |
| ***G03G 21/16*** | (2006.01) |

(52) U.S. Cl.

CPC ..... *B41J 2/471* (2013.01); *G03G 21/1647* (2013.01); *G03G 2215/0119* (2013.01); *G03G 2221/1684* (2013.01)

USPC ..... 399/110; 399/111

(58) Field of Classification Search

USPC ..... 271/162; 399/107, 110, 111, 112, 113, 399/119, 303; 347/104, 101, 108

See application file for complete search history.

(56) References Cited

U.S. PATENT DOCUMENTS

| | | | | |
|---|---|---|---|---|
| 4,949,133 | A | 8/1990 | Landa | |
| 5,019,867 | A * | 5/1991 | Yamakawa et al. | 399/119 |
| 5,182,595 | A * | 1/1993 | Fukuchi et al. | 399/21 |
| 5,587,769 | A * | 12/1996 | Sawada et al. | 399/113 |
| 5,758,232 | A * | 5/1998 | Ikunami | 399/111 |
| 6,659,443 | B1 | 12/2003 | Eskey | |
| 6,708,011 | B2 * | 3/2004 | Nomura et al. | 399/110 |
| 2001/0016125 | A1 * | 8/2001 | Hatano | 399/117 |
| 2003/0161656 | A1 | 8/2003 | Miura et al. | |
| 2003/0185589 | A1 | 10/2003 | Fujita | |

(Continued)

FOREIGN PATENT DOCUMENTS

| | | |
|---|---|---|
| JP | 63-14252 U | 1/1988 |
| JP | 4-40474 A | 2/1992 |

(Continued)

OTHER PUBLICATIONS

English machine translation of Detailed Decription of JP 2005-265979.

(Continued)

*Primary Examiner* — Thomas Morrison
(74) *Attorney, Agent, or Firm* — Banner & Witcoff, Ltd.

(57) ABSTRACT

A color laser printer is configured with a tray being provided above the housing cassette which houses a recording medium. The tray holds developing units and is configured to be pulled out from device main body while leaving housing cassette inside device main body. Furthermore, a sliding support element capable of supporting protrusions of the tray is provided, such that a portion of the tray downstream of the protrusions can be supported on the installation surface when the tray is pulled out from device main body.

17 Claims, 14 Drawing Sheets

(56) References Cited

U.S. PATENT DOCUMENTS

| | | | |
|---|---|---|---|
| 2006/0045566 | A1 | 3/2006 | Kanno et al. |
| 2006/0083543 | A1 | 4/2006 | Sunohara |
| 2010/0080618 | A1 | 4/2010 | Suzuki |

FOREIGN PATENT DOCUMENTS

| | | | | |
|---|---|---|---|---|
| JP | 4-110954 | | * | 4/1992 |
| JP | 4-159533 | | * | 6/1992 |
| JP | 4-184361 | | * | 7/1992 |
| JP | 5-257340 | A | | 10/1993 |
| JP | 9-185309 | A | | 7/1997 |
| JP | 10-149078 | A | | 6/1998 |
| JP | 11-38711 | A | | 2/1999 |
| JP | 2003-266865 | A | | 9/2003 |
| JP | 2004-258230 | A | | 9/2004 |
| JP | 2004-258440 | A | | 9/2004 |
| JP | 2004-264426 | A | | 9/2004 |
| JP | 2005-164727 | A | | 6/2005 |
| JP | 2005-265979 | A | | 9/2005 |

OTHER PUBLICATIONS

JP Office Action dtd Sep. 18, 2008, JP Appln. 2005-098877, partial translation.

* cited by examiner

Fig. 9A
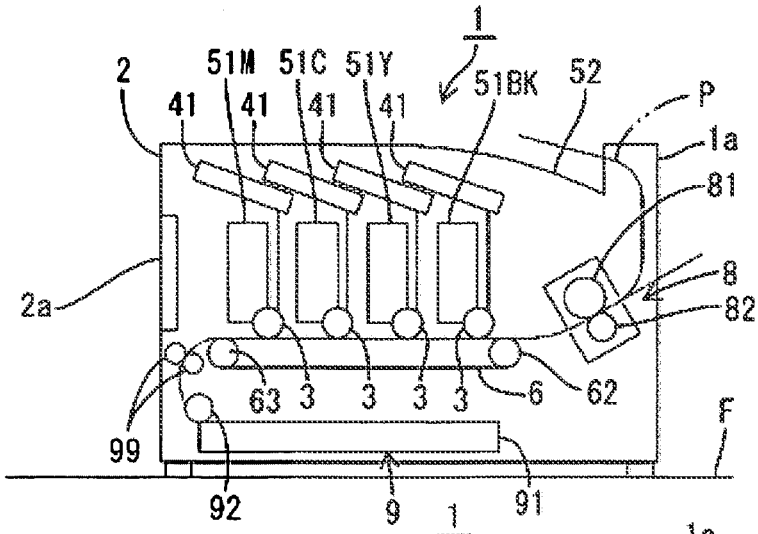
Fig. 9B
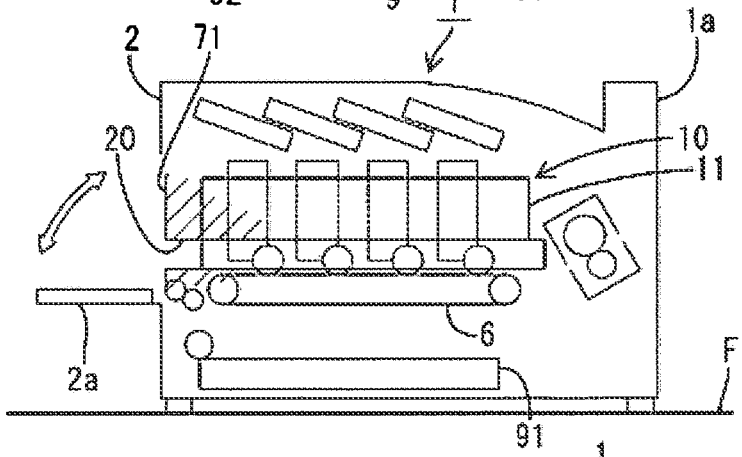
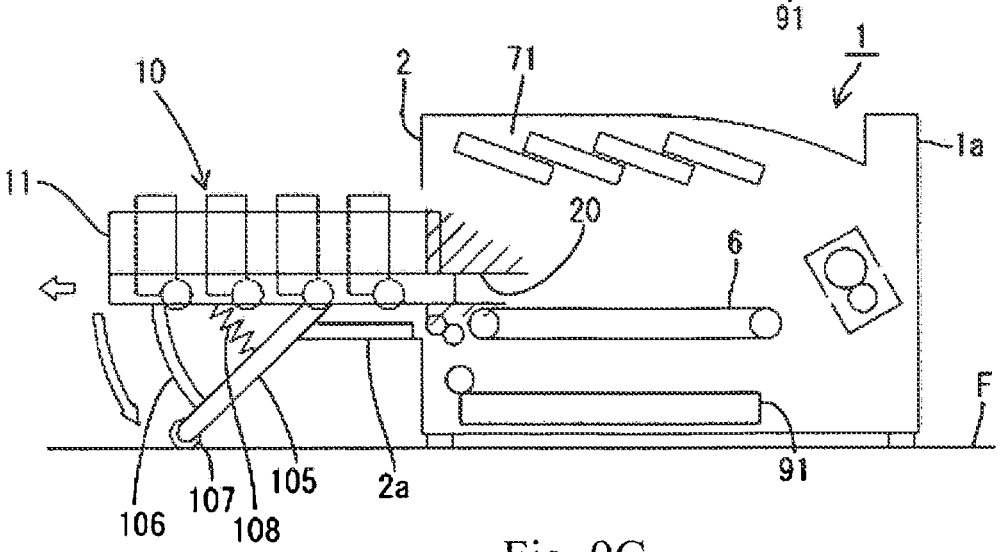
Fig. 9C

Fig. 11A
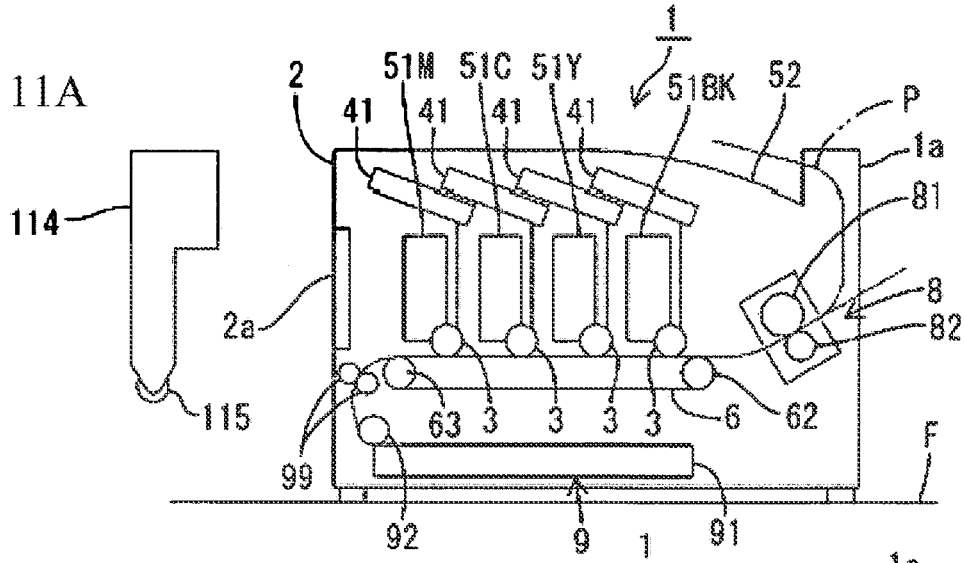
Fig. 11B
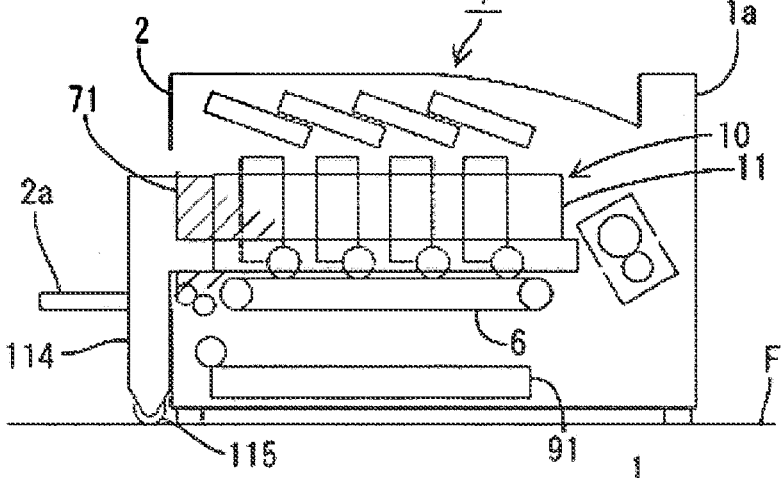
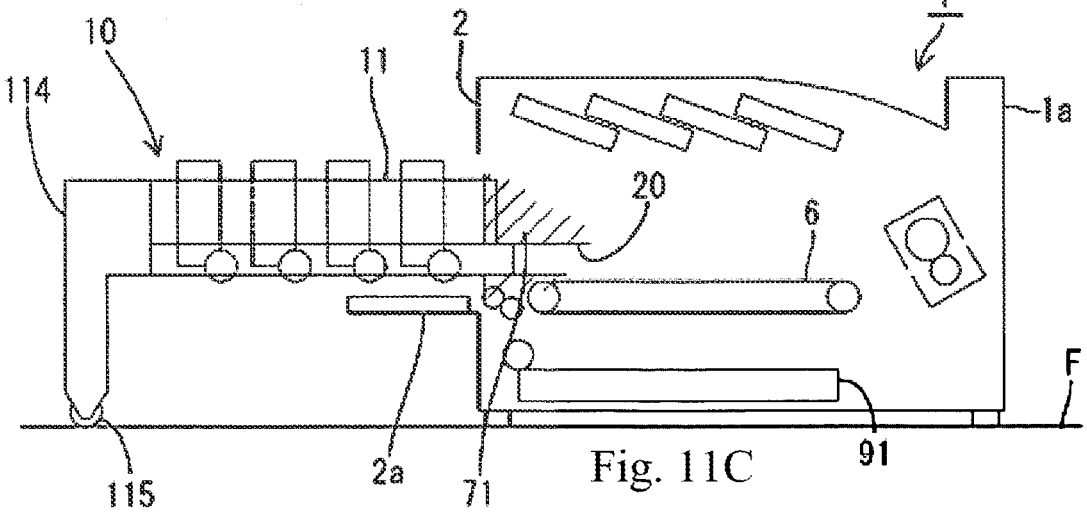
Fig. 11C

Fig. 12A
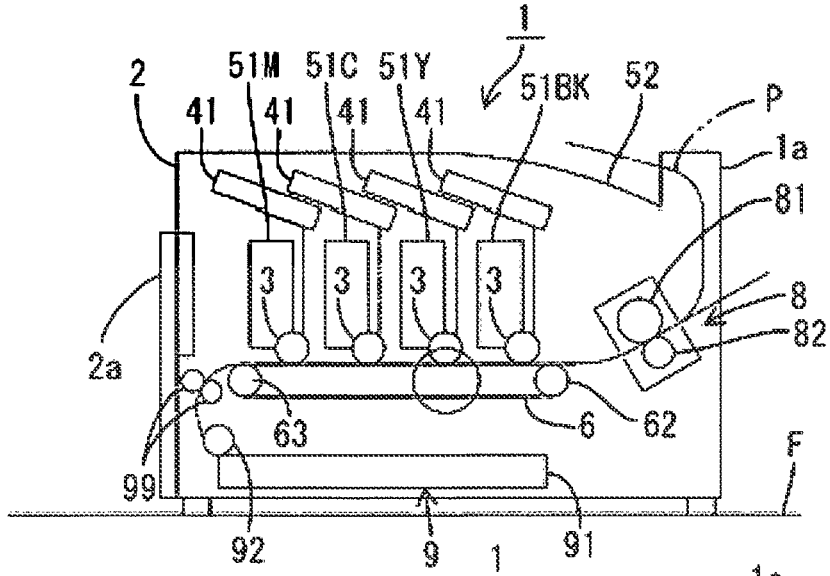
Fig. 12B
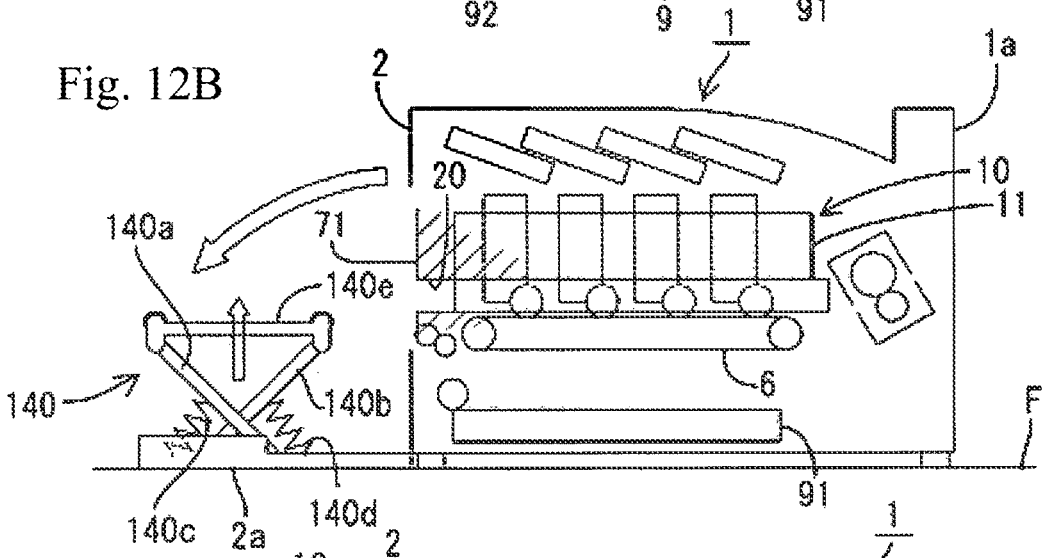
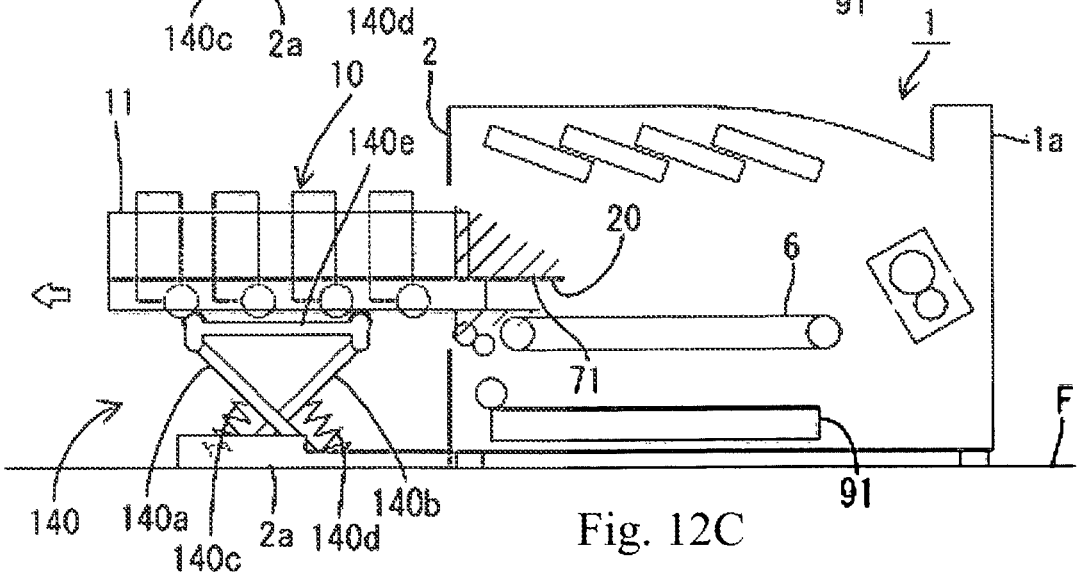
Fig. 12C

Fig. 14A
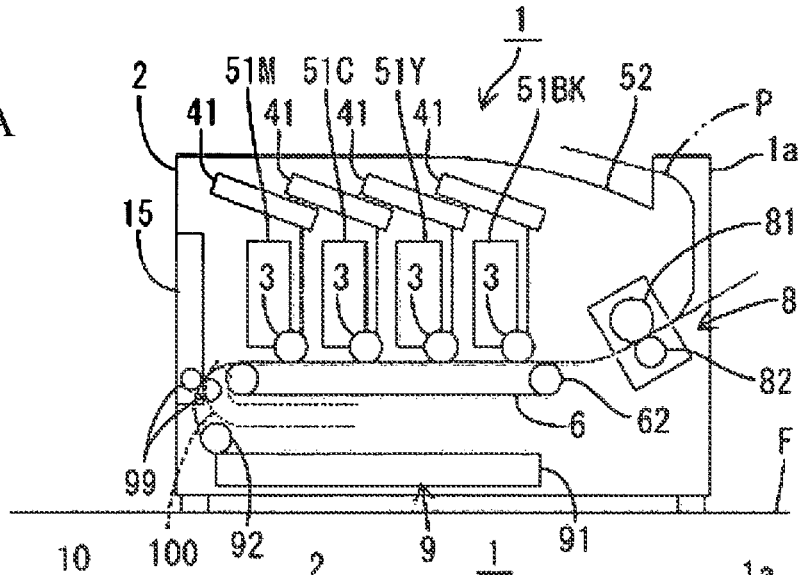
Fig. 14B
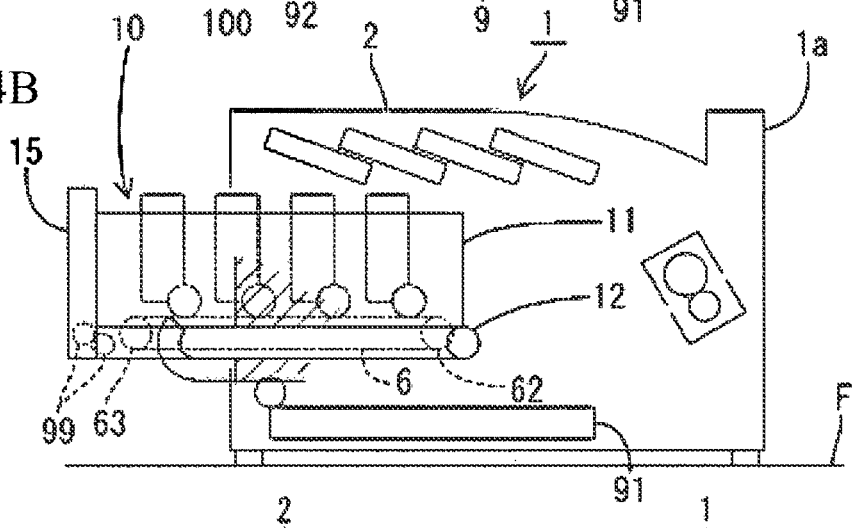
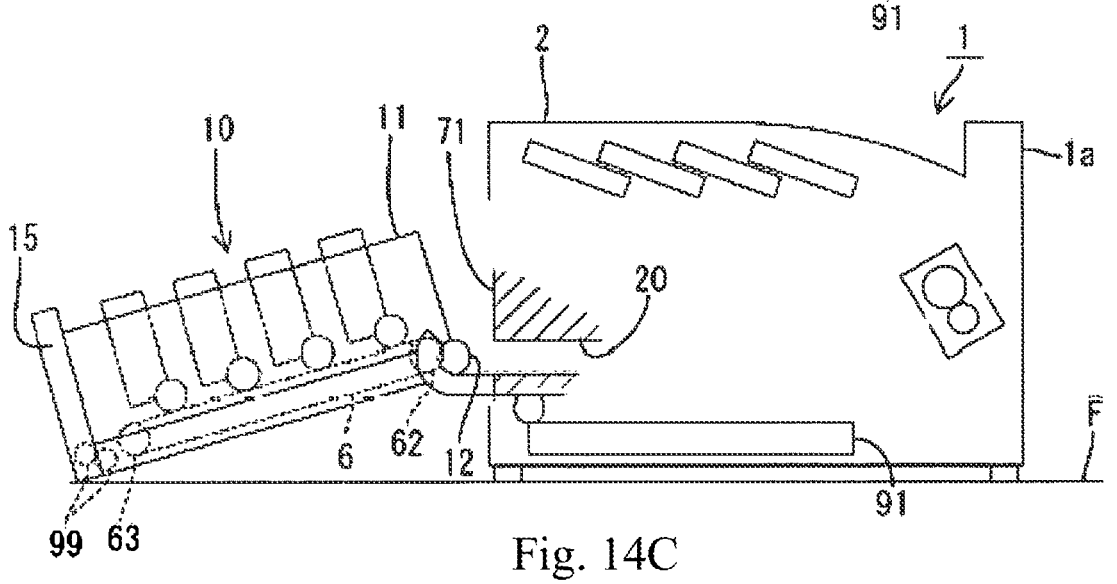
Fig. 14C

IMAGE FORMING DEVICE

CROSS REFERENCE TO RELATED APPLICATION

This application is a continuation of prior U.S. application Ser. No. 11/391,253, filed Mar. 29, 2006, which claims priority to JP 2005-98877 filed Mar. 30, 2005, which applications are herein incorporated by reference.

FIELD

Aspects of the present invention relates to an image forming device.

BACKGROUND

An arrangement which allows items housed within a device main body to be pulled outside the main body has been proposed in the field of image forming devices. Using such an arrangement makes it easier for an operator to access specific components arranged at locations deep inside the device during use (during image forming), increasing the convenience of maintenance. An arrangement of this sort, which enables items housed inside a device main body to be pulled out of the main body, includes for example that of Japanese Unexamined Patent Application Publication H5-257340.

However, with an arrangement that allows items housed inside the device main body to be pulled out of the main body as described above, the device can be easily overturned due to the pull-out. In particular, providing a tray which can be pulled out in cantilever fashion above a housing element which houses a recording medium allows access to housed items other than the recording medium, but the load on the tray when it is pulled out acts strongly upon the device main body via the tray, so the device as a whole can easily overturn.

SUMMARY

Aspects of the invention allow items housed inside the device main body to be pulled out while making it difficult for the device to overturn during pull-out.

BRIEF DESCRIPTION OF THE DRAWINGS

FIG. 9A illustrates a cross-section of another color laser printer according to at least one aspect of the invention.

FIGS. 9B and C illustrate another process of pulling out a tray according to at least one aspect of the invention.

FIG. 11A illustrates a lateral cross-section of another color laser printer according to at least one aspect of the invention.

FIGS. 11B and C illustrate another process of pulling out a tray according to at least one aspect of the invention.

FIG. 12A illustrates a lateral cross-section of another color laser printer according to at least one aspect of the invention.

FIG. 12B and C illustrate another process of pulling out a tray according to at least one aspect of the invention.

FIG. 14 illustrates an application of a tray in which a belt unit can be placed according to at least one aspect of the invention.

DETAILED DESCRIPTION

Illustrative Aspects

Figure 1:
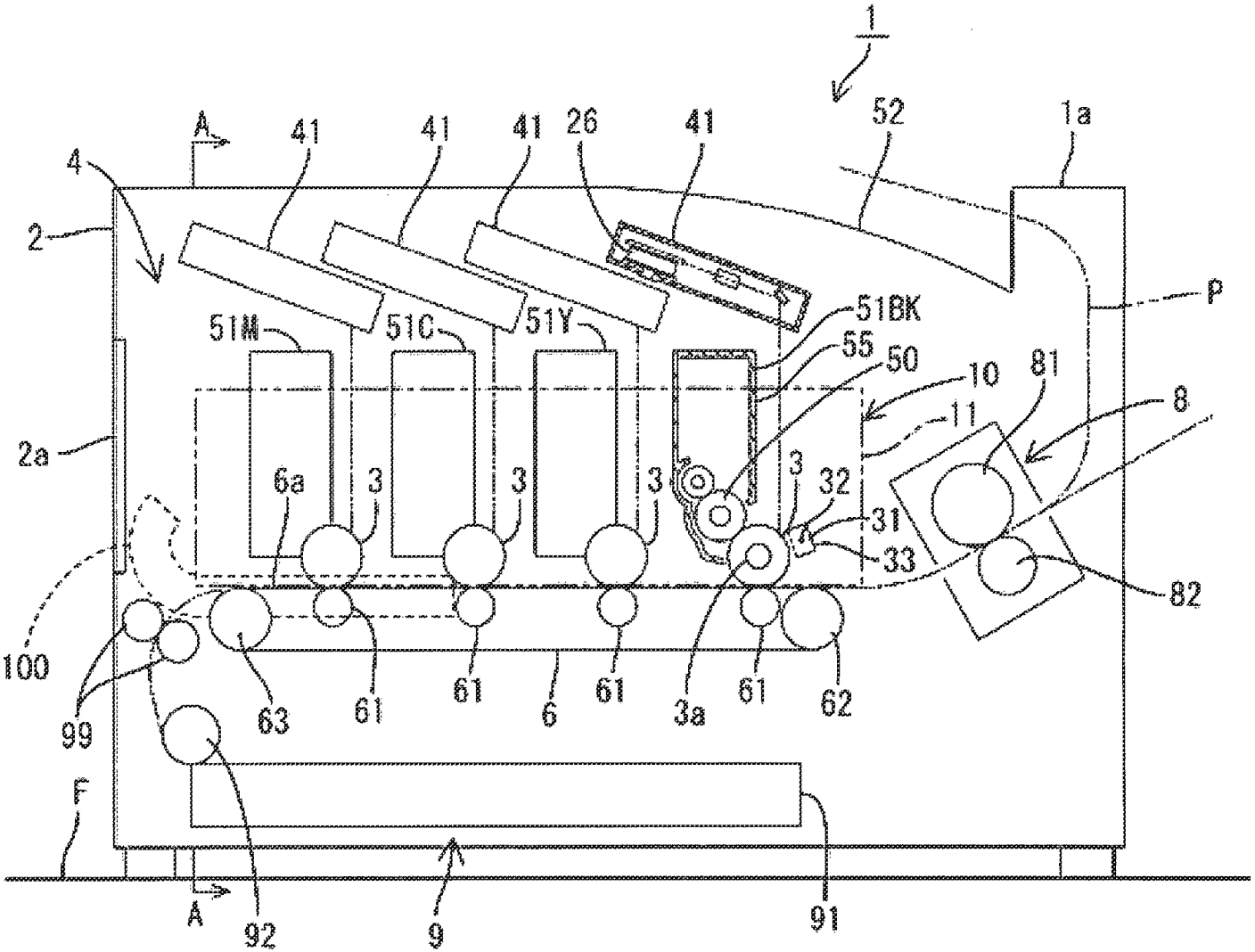
FIG. 1 illustrates a lateral cross-section of a color laser printer according to at least one aspect of the present invention.

Aspects of the present invention will be described with reference to the drawings. FIG. 1 is a simplified drawing representing the internal configuration of a color laser printer 1 according to at least one aspect of the present invention.

An image forming device in the form of the color laser printer 1 is illustrated in FIG. 1. The color laser printer 1 includes a toner image forming unit 4, a paper conveying belt 6, fixing unit 8, paper feed unit 9, paper ejection platform 52 and control unit 10, and forms a four-color image on paper P corresponding to image data input from outside. Paper P corresponds to an illustrative recording medium.

The toner image forming unit 4 includes four developing units 51M, 51C, 51Y, and 51BK, and a photosensitive drum 3, charging device 31, and exposure device 41 for each of the four toner image processes using the magenta (M), cyan (C), yellow (Y), and black (BK) toners stored in the development units 51M, 51C, 51Y, and 51BK.

The developing units 51M, 51C, and 51Y have the same configuration as the black developing unit 51BK, and in FIG. 1, the representative internal configuration is illustrated only for the black developing unit 51BK and is shown in simplified fashion for the other developing units 51M, 51C, and 51Y. Furthermore, in FIG. 2 and subsequent figures, these developing units 51M, 51C, 51Y, and 51BK are shown in simplified fashion.

The photosensitive drum 3 of the toner image forming unit 4 includes a substantially cylindrical member. Four such drums are lined up horizontally at substantially equal spacing and mounted rotatably about a photosensitive element drum shaft 3*a*. For the substantially cylindrical member of the photosensitive drum 3, an aluminum base material with a positively charged photosensitive layer formed thereon, for example, may be used. The aluminum base material can be grounded to the ground line of the color laser printer 1.

Figure 2:
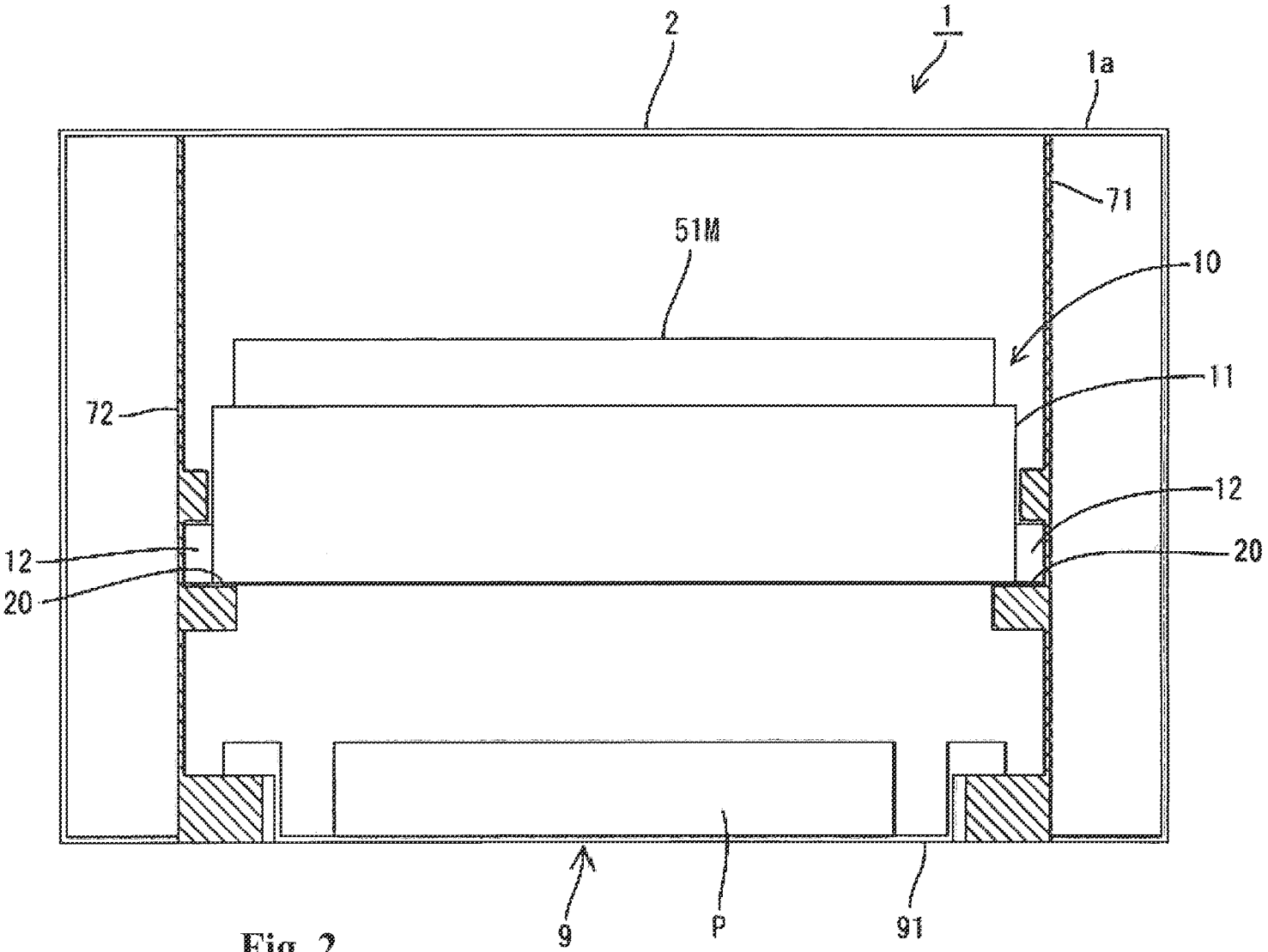
FIG. 2 illustrates a cross-sectional schematic of the frontal cross-section of the color laser printer shown in FIG. 1.

The charging device 31 is a so-called scorotron charging device, which includes a charging wire 32 arranged opposite the photosensitive drum 3 and extending in a widthwise direction, and a shielded case 33 which houses the charging wire 32 and is open on the photosensitive drum 3 side. Applying a high voltage to this charging wire 32 causes the surface of the photosensitive drum 3 to be charged to a positive polarity. Furthermore, the shielded case 33 has a structure with a grid provided at the open part on the photosensitive drum 3 side. Applying a rated voltage to this grid causes the surface of the photosensitive drum 3 to be charged to substantially the same potential as the rated voltage. In FIG. 2 and subsequent figures, the charging device 31 is shown in simplified fashion.

Furthermore, the exposure device 41 is rotationally driven by a polygonal motor 26, irradiating the surface of the photosensitive drum 3. The exposure device 41 is arranged to expose each photosensitive drum 3 downstream of the charging device 31 in the direction of rotation of the photosensitive drum 3 by emitting laser light from a light source according to image data of one color input from outside, and scanning the laser light with a polygonal mirror or the like. In FIG. 1, the representative internal configuration is shown for the exposure device 41 corresponding to the black developing unit 51BK. The exposure devices 41 corresponding to the developing units 51M, 51C, and 51Y have the same structure and are shown in simplified fashion. In FIG. 2 and subsequent figures, all exposure devices 41 are shown in simplified fashion.

When the surface of the photosensitive drum 3 is irradiated with laser light corresponding to image data by the exposure device 41, the surface potential of the irradiated area drops, and a static latent image is formed on the surface of the photosensitive drum 3 as a result.

As illustrated representatively for developing unit 51BK, the developing units 51M, 51C, 51Y, and 51BK include a developing unit case 55 which houses toner and is provided with a developing roller 50. The developing units 51M, 51C, 51Y, and 51BK are arranged so that the developing roller 50 contacts the photosensitive drum 3 downstream of the exposure device 41 in the direction of rotation of the photosensitive drum 3. The developing units 51M, 51C, 51Y, and 51BK give a "+" (positive polarity) charge to the toner and supply the charge in a uniform thin layer to the photosensitive drum 3, and the "+" (positive polarity) charged toner is developed by a reversal development method in response to the "+" (positive polarity) static latent image formed on the photosensitive drum 3 at the contact position between the developing roller 50 and the photosensitive drum 3.

The developing roller 50 is fashioned in a cylindrical shape with conductive silicone rubber or the like as the base material, with a coating layer of rubber material or resin containing fluorine formed on the surface thereof.

Furthermore, the toner contained in the developing unit case 55 is a positive charging non-magnetic one-component toner, with the developing units 51M, 51C, 51Y, and 51BK holding magenta, cyan, yellow, and black toner, respectively.

Furthermore, the paper feed unit 9 is provided in the lowermost part of the device and includes a housing cassette 91 which houses paper P and a pick-up roller 92 which feeds out the paper P. The paper P housed in the housing cassette 91 is extracted one sheet at a time by the pick-up roller 92 from the paper feed unit 9 and is fed to the paper conveying belt 6 by conveying rollers 99 and the like.

Furthermore the paper conveying belt 6 is fashioned as an endless belt to travel integrally with the paper P carried on its top surface and circulates over a drive roller 62 and follower roller 63, with transfer rollers 61 being arranged near the location opposite each photosensitive drum 3.

As shown in FIG. 1, the surface 6a of the paper conveying belt 6 on the side facing the photosensitive drum 3 is moved by the rotation of drive roller 62 from left to right in the drawing, and pieces of paper arriving from the conveying rollers 99 are conveyed sequentially between the photosensitive drum 3 and the belt and sent to the fixing unit 8.

Each transfer roller 61 can be connected to a constant current source (not shown), and is configured so that a transfer bias of opposite polarity to the polarity of the toner charge is applied between the transfer roller 61 and the photosensitive drum 3 from the constant current source when transferring toner to the transfer target element (paper P), whereupon the toner image formed on the photosensitive drum 3 is transferred to the paper P being conveyed by the paper conveying belt 6.

The fixing unit 8 includes a heating roller 81 and a pressurizing roller 82, applying heat and pressure to paper P to cause the toner image to be fixed to the paper P. Paper P carries a four-color toner image while being conveyed between the heating roller 81 and the pressurizing roller 82.

Furthermore, a paper ejection platform 52 is formed on the top surface of the color laser printer 1. The paper ejection platform 52 is provided on the paper ejection side of the fixing unit 8 and holds paper ejected from the fixing unit 8.

Next, the operation of forming an image on the paper P in the color laser printer 1 will be described. First, one sheet of paper P is supplied by the pick-up roller 92 from the paper feed unit 9 illustrated in FIG. 1, and is fed to the paper conveying belt 6 via conveying rollers 99.

Next, the surface of the leftmost photosensitive drum 3 in FIG. 1 (i.e. the photosensitive drum 3 corresponding to the magenta developing unit 51M) is charged uniformly to a prescribed voltage by the charging unit 31 and is exposed by exposure unit 41 in accordance with the magenta image data input from outside. The potential of just the exposed area falls, forming a static latent image. Next, in the developing unit 51M, magenta toner charged to a positive polarity by developing roller 50, to which a positive developing bias is applied, is supplied to the surface of the photosensitive drum 3 to carry out development, with the magenta toner adhering only to areas where the static latent image has been formed and the potential has been reduced by the developing bias. The "+" (positive polarity) charged toner image formed in this manner is then transferred to the surface of the paper P conveyed by the paper conveying belt 6 by the transfer roller 61, to which a negative polarity transfer bias is applied. After this transfer has been carried out, the magenta toner charged to a "+" (positive polarity) and transferred to the paper P by transfer roller 61 adheres to the paper P.

Next, the paper P is sequentially conveyed to the locations opposite the photosensitive drums 3 for cyan toner, yellow toner and black toner, and by the same procedure as for magenta toner, a toner image can be formed on the surface of the photosensitive drum 3 and overlaid onto the paper P by the transfer roller 61. Finally, the four-color toner image formed on the paper P is fixed on the paper P in the fixing unit 8, and the paper P is ejected to the paper ejection platform 52.

Next, the tray will be described.

Figure 3A:
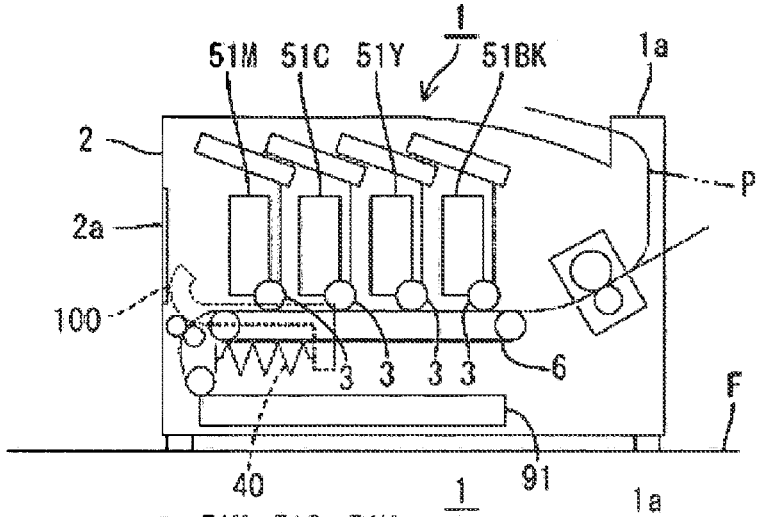
FIG. 3 illustrates a process of pulling out the tray according to at least one aspect of the invention.
Figure 3B:
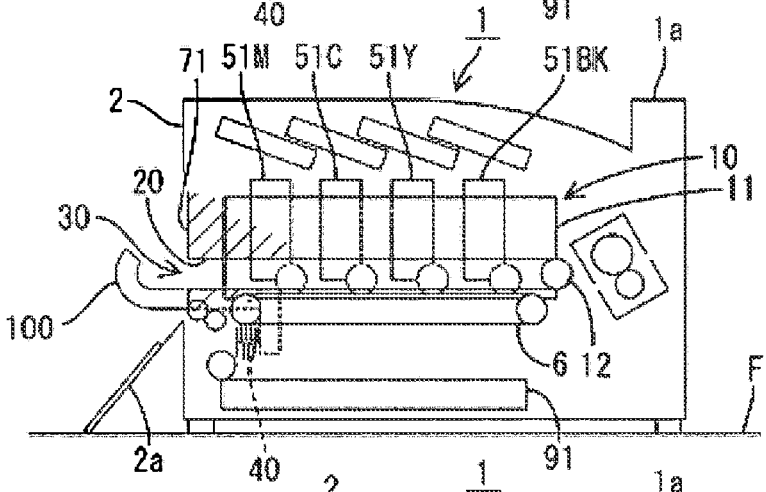
Figure 3C:
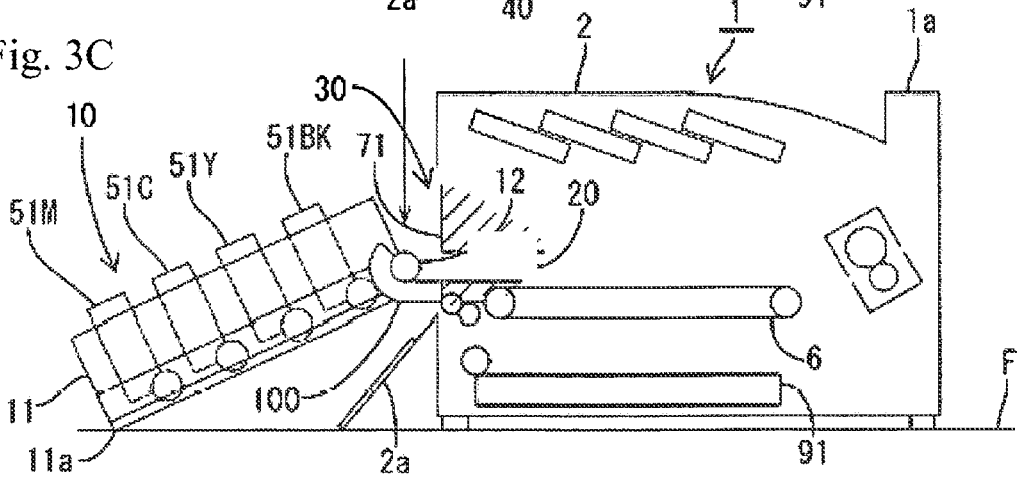

FIG. 2 shows the frontal cross-section of color laser printer 1 (cross-section near A-A in FIG. 1), with some of the components being shown in simplified fashion. FIGS. 3A through C explain the process of pulling out the tray according to aspects of the invention. FIG. 3A illustrates the state of FIG. 1 in simplified fashion, while FIGS. 3B and C present the inside of the device in a side view along with a conceptual representation of a partial cross-section of a wall area.

In the color laser printer 1 according to at least one aspect, a tray 11, in which the developing units 51M, 51C, 51Y, and 51BK are placed, is arranged above the holding cassette 91 which holds the paper P. In this description, "upward" signifies vertically upward and "downward" signifies vertically downward. This tray 11, as illustrated in FIG. 2, is configured to be supported by a guide groove 20 and to slide along this guide groove 20. Furthermore, this tray 11 is made displaceable independently of the holding cassette 91, and can be pulled out from the device main body 1*a* while leaving the holding cassette 91 inside the device main body 1*a*.

According to certain aspects, a pair of protrusions 12 (see also FIGS. 3B and C) is provided at the upstream end in the pull-out direction of tray 11, and the guide groove 20 is provided to support these protrusions 12. The protrusions 12 are configured to protrude outward in the widthwise direction from the two sidewalls of the tray 11, as shown in FIG. 2.

The guide groove 20, as shown conceptually in FIGS. 3B and C, is formed into a groove shape in a direction substantially parallel to the installation surface F in the wall areas 71 and 72 (FIG. 2). In the example of FIG. 2, the guide groove 20 is also configured so as to support the bottom end part of the tray 11 other than the protrusions 12 (specifically, the two widthwise ends of the bottom end part). This arrangement allows the tray 11 to move along the guide groove 20 and makes it possible to pull out the whole unit 10 along the installation surface F.

To pull out the unit 10 including the tray 11, first, from the state of FIG. 3A, the front cover 2*a* is opened, the front cover being arranged to be opened and closed on the front surface of the main body casing 2. The opening 30 formed in the device main body 1*a* can be exposed as a result, as shown in FIG. 3B, and the tray 11 becomes accessible through the opening 30. Then, from the state of FIG. 3B, the tray 11 is pulled out until the protrusions 12 engage with the pivot support elements 100 at a pulled out position, whereupon the unit 10 moves out of the main body casing 2.

A pair of pivot support elements 100 is provided to support the pair of protrusions 12 (only one of the elements is illustrated in FIG. 3), and the existence of this pivot support element 100 makes it possible to pivot the tray 11 (and thus, the unit 10) centered about the protrusions 12. Specifically, after pulling the unit 10 out of the main body casing 2 to the pulled out position, the downstream side of the unit 10 in the pull-out direction is pivot downward (toward the installation surface F), as a result of which a portion of the downstream side of the tray 11 (specifically, the corner part 11*a*) comes to be directly supported on the installation surface F on which the color laser printer 1 is installed, as illustrated in FIG. 3C. In other words, a tilted state is assumed, with the protrusions 12 formed on the upstream side being supported by the pivot support element 100 and the angle part 11*a* on the downstream side being supported by the installation surface F. The "directly supported arrangement" referred to here is the arrangement whereby a portion of the tray 11 directly contacts the installation surface F, as illustrated in FIG. 3C.

According to some aspects, when the tray 11 is pulled out from the main body casing 2, the upstream side can be supported on the main body casing 2 side while the downstream side can be supported by utilizing the installation surface F, so the tray 11 is not cantilevered, making it possible to effectively prevent overturning of the device. In devices with the tray 11 being arranged to be pulled out above the holding cassette 91 which holds the paper, if the tray is cantilevered, a large force will be applied upward, making the device prone to overturning. The arrangement whereby a portion of the downstream side of the tray 11 is supported on the installation surface, as in FIG. 3C, or the arrangement whereby a portion of the downstream side of the tray 11 pivots downward (FIG. 4B, described below)) can make a device less susceptible to overturning.

Furthermore, pivot support element 100 is made displaceable between an in-use position (i.e. a forward position) protruding downstream in the pull-out direction of the tray 11 from the main body casing 2*a* of the device main body 1*a* (the position in FIG. 3B) and a retracted position in which it is housed inside the main body casing 2 (the position in FIG. 3A). Specifically, when in the retracted position as in FIG. 3A, the pivot support element 100 is supported at the front by the front cover 2*a* while being impelled in the direction of pivoting by a spring member 40, and when the front cover 2*a* opens, the front support is removed, and the pivot support element 100 is displaced by the spring member 40 to the in-use position as shown in FIG. 3B. This arrangement makes it possible to house the pivot support element 100 inside the main body casing 2 when not pivoting the tray 11, allowing the device to be made more compact. The arrangement shown here is only an example. Other arrangement may be used so long as they allow the displacement between an in-use position protruding out from the main body casing 2 and a retracted position housed within the main body casing 2. For example, an arrangement can be used whereby displacement between the in-use position and retracted position is accomplished by rotation.

Moreover, since according to some aspects, protrusions 12, constituting the first supported part, are provided on the tray 11 on the upstream side in the pull-out direction, and the pivot support element 100 is provided in the device main body 1*a* at the downstream side end in the pull-out direction of the tray, the space needed for sliding inside the device main body 1*a* can be reduced. Therefore, it becomes less likely for other elements to be restricted by the arrangement for sliding, increasing the degree of freedom of device configuration.

Furthermore, since in some aspects, the existence of the pivot support element 100 allows the part of the tray 11 downstream of the protrusions 12 to be pivoted downward when pulled out from the device main body 1*a* to the pulled out position, the center of gravity of the tray 11 can be brought closer to the device main body side by pivoting as compared to a cantilevered state where the tray 11 is just pulled out horizontally. Therefore, even with an arrangement where a portion of the downstream side of the tray 11 cannot be supported, as in FIG. 4A, the unit 10 is suspended from the pivot support element 100, so it is still possible to provide a support that makes overturning less likely than in a cantilevered arrangement. In other words, since the moment generated on the device main body 1*a* can be made smaller as compared to the case of pulling out into a cantilevered state, the device becomes less prone to being upset, providing for an arrangement which allows overturning of the device to be effectively suppressed.

Figure 4A:
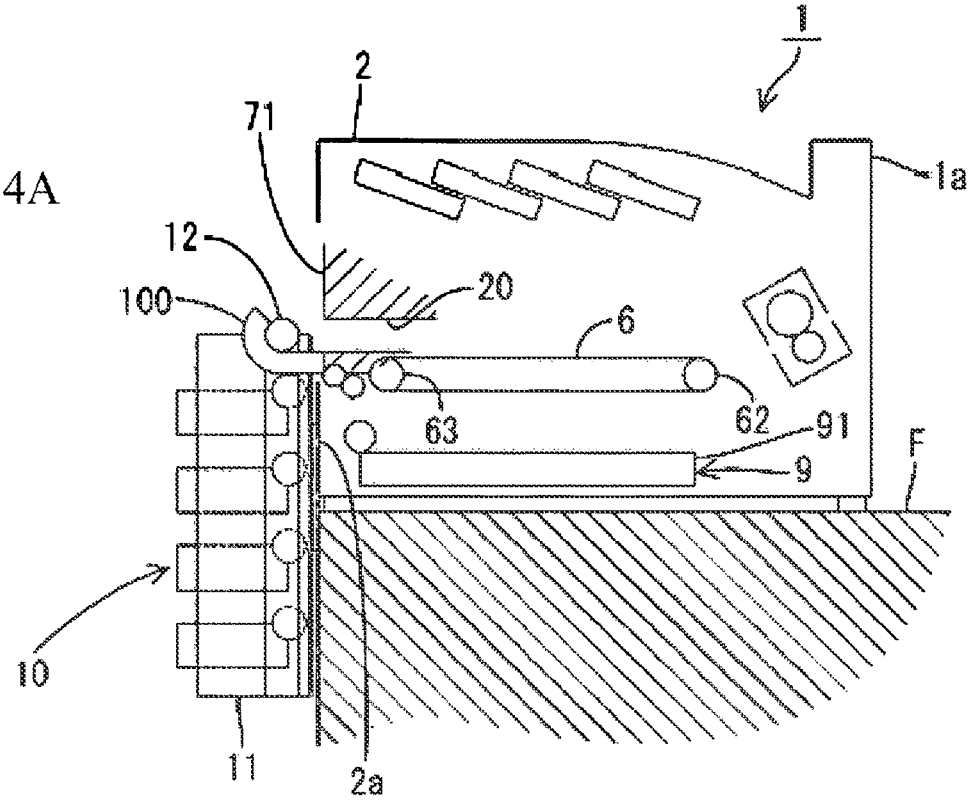
FIG. 4A illustrates a tray suspended from a pivotal support element according to at least one aspect of the invention.

In this way, by pivoting the tray 11, the tray 11 can be suspended in a position near the device main body 1*a*, as shown in FIG. 4A, or to support a portion of the downstream side of the tray 11 in the pull-out direction on the installation surface, as shown in FIG. 3C, and using either of these support methods allows for a more stable support which makes toppling less likely than when the tray is held in a cantilevered state.

Figure 4B:
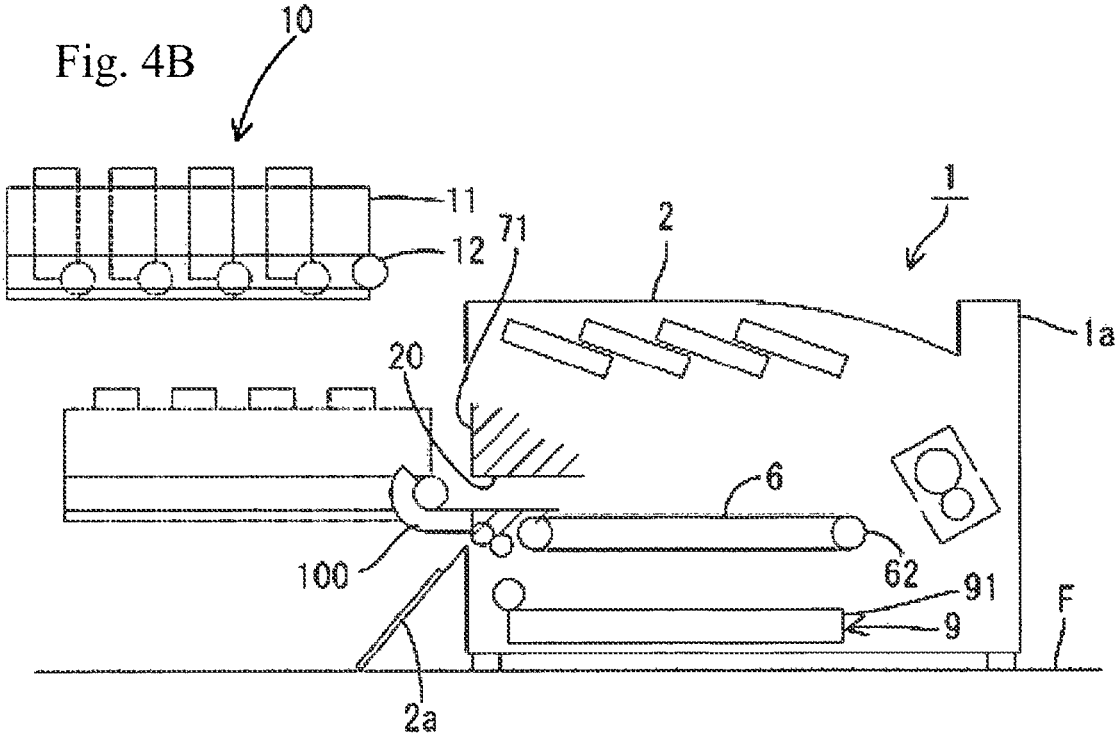
FIG. 4B illustrates a process of pulling out the tray according to at least one aspect of the invention.

In addition to being supportable on the pivot support element 100, as shown in FIG. 3C and FIG. 4A, the tray 11 can also be detached from the device main body 1*a*, as shown in FIG. 4B. In other words, the upper part of the pivot support element 100 is open, and moving the unit 10 upward from the state of FIG. 3C or FIG. 4A allows the tray 11 to be detached from the device main body 1*a*. This arrangement makes it easier to access the items held inside the tray 11 which can improve workability during maintenance.

Furthermore, as discussed above, the developing apparatus, i.e. the developing units 51M, 51C, 51Y, and 51BK are placed in the tray 11, and a configuration which places the developing apparatus, with its high replacement frequency, into the tray 11 also increases the frequency of pulling out of the tray 11. The arrangement can prevent overturning of devices with this sort of configuration, so the operator does not need to always be concerned about overturning when pulling out the tray, making for an arrangement which is very easy to use for the operator.

Figure 5A:
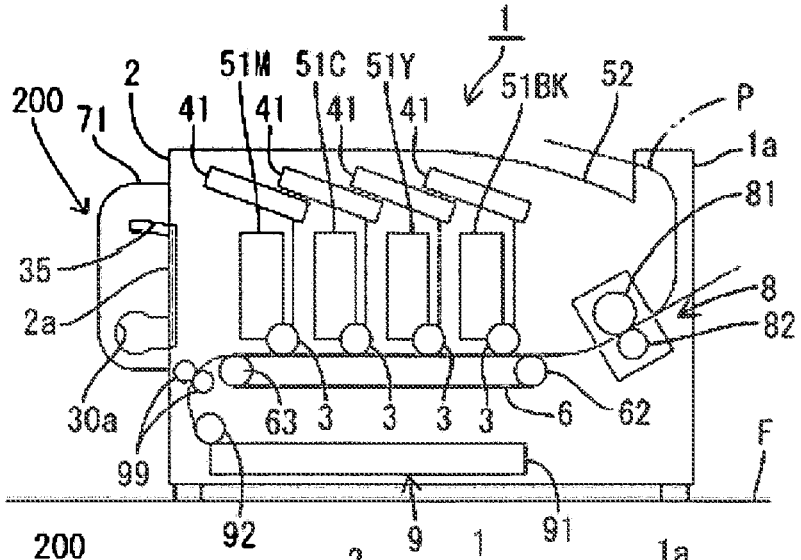
FIG. 5A illustrates a lateral cross-section of another color laser printer according to at least one aspect of the invention.
Figure 5B:
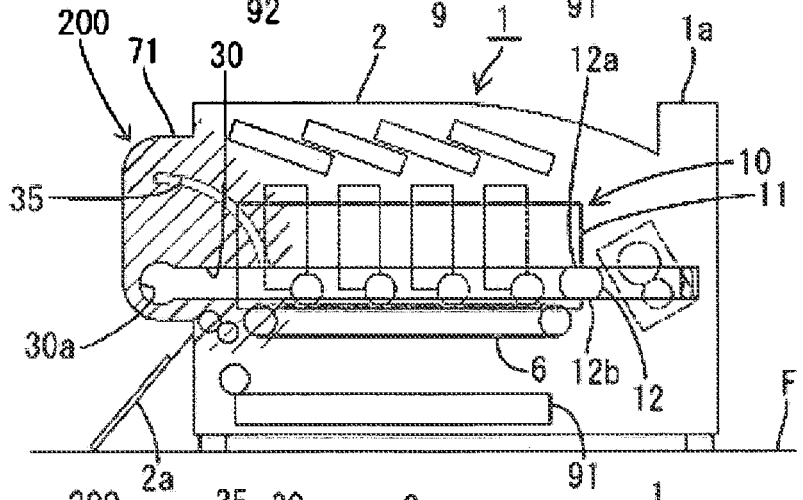
FIGS. 5B and C illustrate another process of pulling out a tray according to at least one aspect of the invention.
Figure 5C:
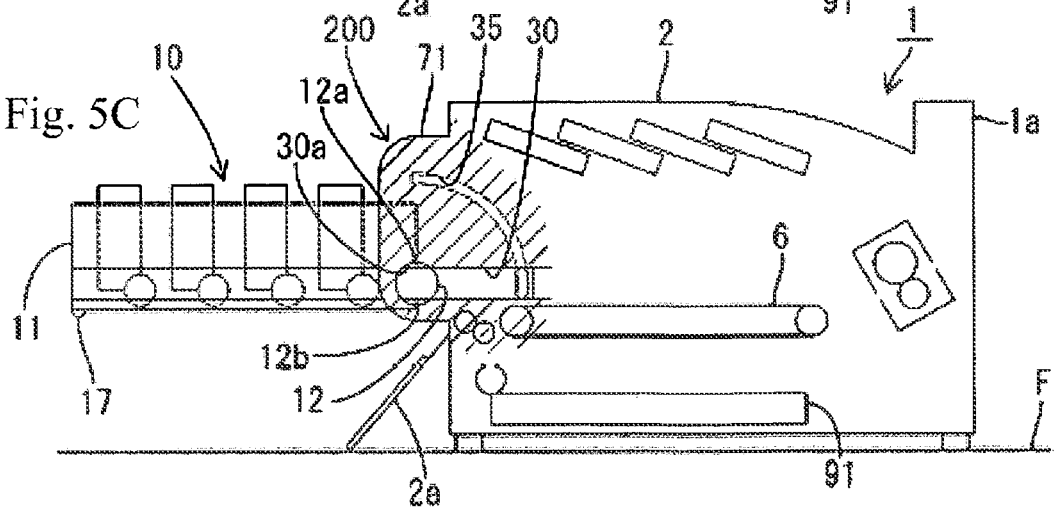
Figure 6:
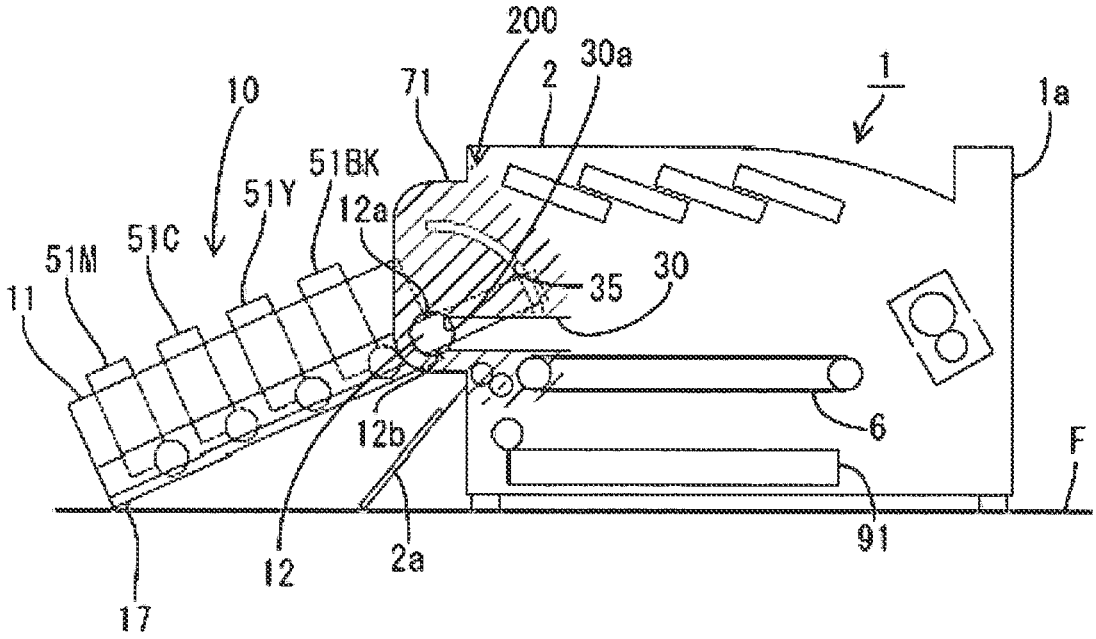
FIG. 6 illustrates how a tray is supported on the installation surface according to at least one aspect invention.

Next, aspects of the present invention will be described with reference to FIGS. 5 through 8. FIG. 5A is a lateral cross-section schematically illustrating the configuration of the color laser printer according to at least one aspect. FIGS. 5A through C explain the process of pulling out the tray. FIGS. 5B and C provide a simplified side view of the inside of the device along with a conceptual representation of a partial cross-section of a wall area. Furthermore, FIG. 6 is an illustration explaining the state where the tray is supported on the installation surface, FIG. 7 is an illustration explaining the click mechanism, and FIG. 8 is an illustration explaining the resistance imparting mechanism. The arrangement includes both the click mechanism 120 shown in FIG. 7 and the resistance imparting mechanism 130 shown in FIG. 8, but for ease of explanation, the resistance imparting mechanism has been omitted from FIG. 7 and the click mechanism has been omitted from FIG. 8.

As shown in FIG. 5A, developing units 51M, 51C, 51Y, and 51BK are arranged above the holding cassette 91. A tray 11 is provided for loading the developing units as shown in FIG. 5B. The device is configured such that the tray 11 can be pulled out from the device main body 1*a* while leaving the holding cassette 91 inside the device main body 1*a*, as shown in FIGS. 5A and B. Furthermore, protrusions 12 are provided on the upstream side of the tray 11 in the pull-out direction, and guide grooves 30 capable of supporting the protrusions 12 are provided in the device main body 1*a*. The guide grooves 30 are formed in the wall areas in the same way as described according to another aspect (FIG. 5 shows only one of the wall areas 71).

A pivot support element 200 which pivotally supports the tray 11 centered on the protrusions 12 is provided in the device main body 1*a* at the downstream end in the pull-out direction (specifically, near the downstream end of the guide grooves 30). In this aspect, the existence of the pivot support element 200 allows the downstream portion of the tray 11 to be pivoted downward while pulling the tray out from the device main body 1*a*.

This downward pivoting allows the tray 11 to be supported on the installation surface via another member, as shown in FIG. 6. Specifically, a convex element 17 is mounted on the downstream bottom end of the tray 11, and the tray 11 is configured to be supported on the installation surface F by convex element 17. A pair of convex elements 17 is provided at the locations of the two widthwise ends of the tray 11, supporting the tray while maintaining its balance in the widthwise direction. According to other aspects the tray 11 can be supported directly on the installation surface as described above. Conversely, it is also possible to provide a convex element similar to convex element 17 of FIG. 6 in aspects of the invention including those described previously 1.

Figure 7A:
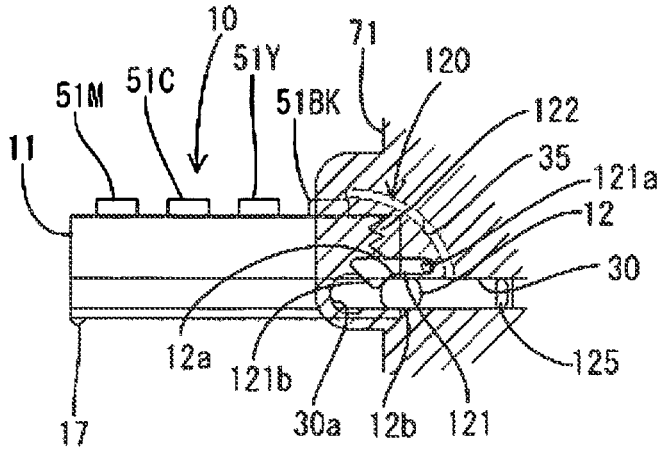
FIG. 7 illustrates a click mechanism according to at least one aspect of the invention.
Figure 7B:
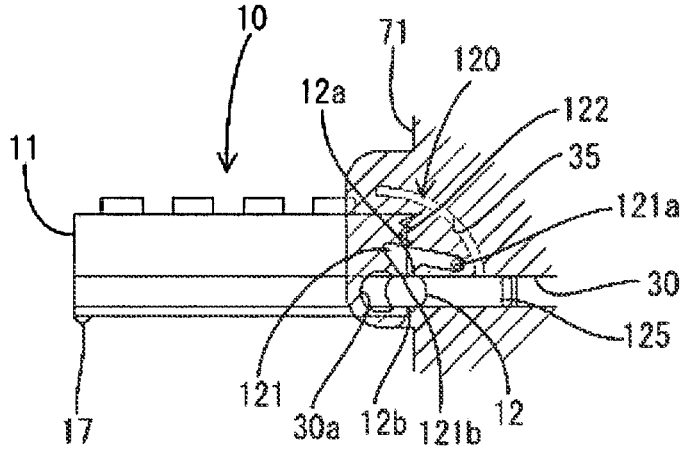
Figure 7C:
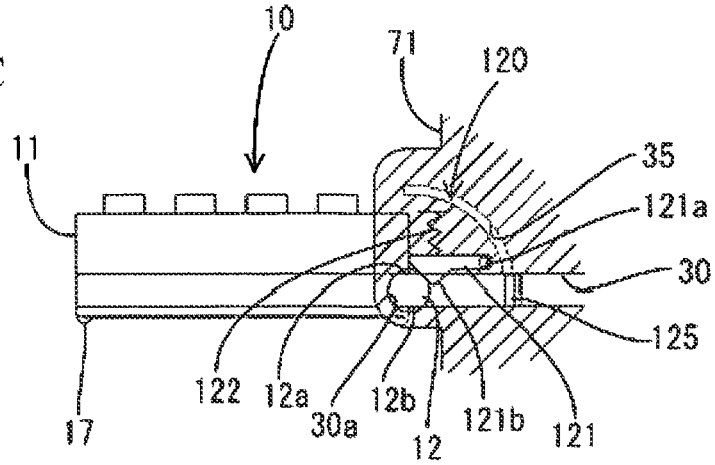

The pivot support element 200, as illustrated in FIG. 7A, is provided with a click mechanism 120 which changes the withdrawal force in the pull-out direction of tray 11 between an installation position at which the tray 11 is installed in the device main body 1*a* and a pivot position at which pivoting becomes possible based on support by the pivot support element 200. This click mechanism 120 includes a pivoting member 121 pivotable about a shaft 121*a*, and a spring member 122 capable of impelling the pivoting member 121. In FIG. 7A, the spring member 122 is in its natural state, in which state, the convex part 121*b* formed in the pivoting member 121 protrudes so as to overlap the guide groove 30 in the vertical direction. Then, as shown in FIG. 7B, once the protrusion 12 moves downstream as the tray 11 is pulled out, the pivoting member 121 moves upward against the impelling force of the spring member 122, with a load being applied by the spring member 122 and convex part 121*b* as the tray is moved. The load lets the operator know that the tray 11 has moved close to the end. If the movement of the tray 11 progresses further, the protrusion 12 moves downstream of the convex part 121*b* of the pivoting member 121, reaching the pull-out position where the tray 11 can be pivoted, as shown in FIG. 7C. At the end of the guide groove 30, there is formed a bearing part 30*a*, which has a circular arc shaped cross-section. Upon reaching the end of the guide groove 30, the protrusion 12 becomes rotatable. Since the load disappears at this rotatable position, the operator can know, based on this change in load, that the tray 11 has reached the pivotable position and the pull-out position. Configuring the click mechanism 120 in this manner gives the operator a sense of clicking and allows the operator to be provided with an indication that tray is near the pivoting position. It will be appreciated that other structures and devices could be used to provide an indication that the tray is approaching the pivoting position such as a detector, which provides visual or aural feedback, all of which are within the scope of the invention.

According to a least one aspect, a pair of flat parts 12*a* and 12*b* is formed on the protrusion 12. These flat parts 12*a* and 12*b* are designed to fit the guide groove 30. When the protrusion 12 has not yet reached the end, as in FIGS. 7A and B, the flat parts 12*a* and 12*b* engage the guide groove 30, making rotation impossible, and once the protrusion 12 reaches the bearing part 30*a* as in FIG. 7C, this engagement is cancelled, and the protrusion 12 becomes rotatable.

Figure 8A:
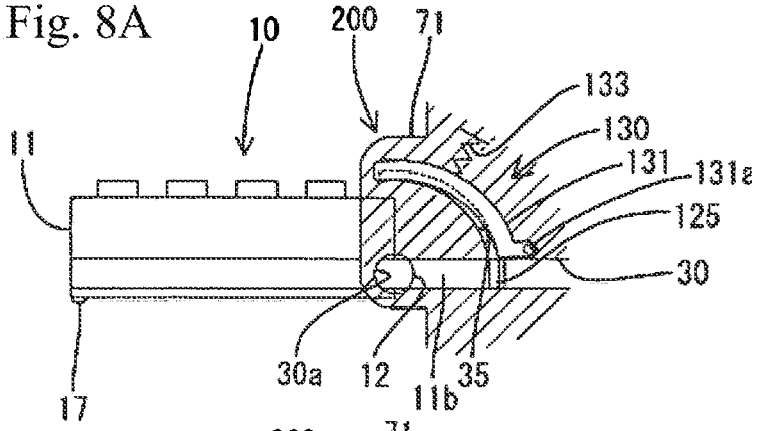
FIG. 8 illustrates a resistance imparting mechanism according to at least one aspect of the invention.
Figure 8B:
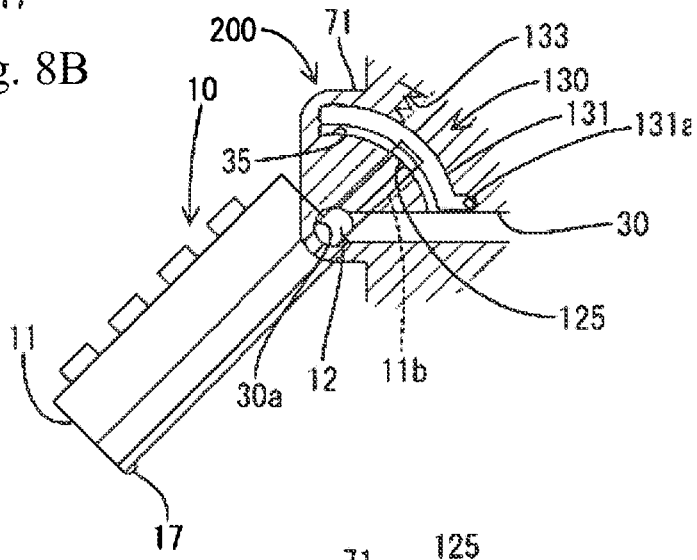

Furthermore, the pivot support element 200 is provided with a resistance imparting mechanism 130, as shown in FIG. 8, which imparts a force resisting the pivoting of the tray 11 when the tray 11 is pivoted. The resistance imparting mechanism 130 includes a rotating member 131 which rotates about a shaft 131*a* and a spring member 133 which impels the rotating member 131. Furthermore, an extension 11*b* is formed upstream of the tray 11, and a second protrusion 125 is formed on the extension 11*b*. As shown in FIGS. 8A, B, and C, when the tray 11 pivots at the pivoting position, the second protrusion 125 moves along a groove 35 formed by a pair of wall areas (here, only wall area 71 is illustrated). Here, the second protrusion 125 moves along the groove 35 while pushing away the rotating member 131, at which time a load is applied from the spring member 133. In other words, while the second protrusion 125 is moving through the groove 35, as shown in FIGS. 8B and C, the rotating member 131 is constantly impelled by the spring member 133, generating friction between the rotating member 131 and the second protrusion 125. A force resisting the pivoting of the tray 11 is imparted by this friction. The resistance imparting mechanism 130 fashioned in this manner can suppress abrupt pivoting of the tray 11, which can prevent problems due to abrupt pivoting.

Furthermore, the pivoting of the tray 11 upward from a horizontal state is constrained. Namely, if one attempts to pivot the tray 11 further upward from the horizontal state shown in FIG. 8A, the second protrusion 125 will come into contact with the bottom wall part of the guide groove 30, thereby constraining the upward pivoting of the tray 11. This arrangement prevents the tray 11 from pivoting upward more than necessary, providing for greater ease of use.

Furthermore, the arrangement according to some aspects also allows the center of gravity of the tray 11 to be brought closer to the device main body by pivoting as compared to when the tray 11 is pulled out horizontally into a cantilevered state. So even with an arrangement where a portion of the downstream side of the tray 11 cannot be supported, by suspending the unit 10 from pivoting support element 200, as shown in FIG. 8C, it is still possible to provide support that makes overturning less likely than in the cantilevered case.

Figure 8C:
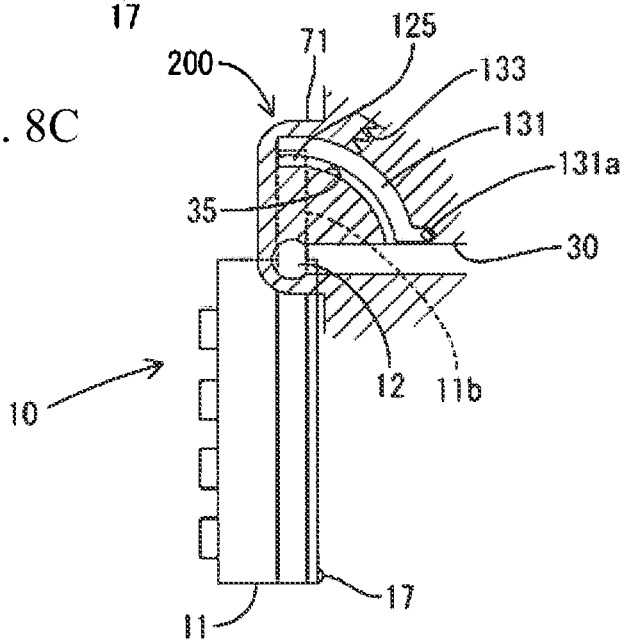

In this way, the tray 11 can be suspended in a position near the device main body 1*a*, as shown in FIG. 8C, or to support a portion of the downstream side of the tray 11 in the pull-out direction on the installation surface, as shown in FIG. 6. Using either of these support methods allows for a more stable support which makes toppling less likely than when the tray 11 is held in a cantilevered state.

FIG. 9A is a lateral cross-section schematically illustrating the color laser printer according to aspects of the invention FIGS. 9B and C are illustrations schematically showing how a tray is pulled out of the color laser printer 1.

According to some aspects, the tray 11 can be supported indirectly by another member. Specifically, legs 105 can be provided to support the second supported part (the part supported by the legs 105) of the tray 11 pulled out from the device main body 1*a* in a state where the legs contact the installation surface F. The legs 105 are provided in a pair, one on each widthwise end of the tray 11, and support the tray while maintaining its balance in the widthwise direction. In FIG. 9C, only the near side leg 105 is shown.

In some aspects, the front cover 2*a* is designed to rotate up to 90° from the closed state of FIG. 9A, as shown in FIG. 9B, and to not rotate any further downward from that position. The legs 105 are impelled downward by a spring member 109, whereby the tray 11 is maintained in a substantially horizontal state when the legs 105 are in contact with the installation surface F. Furthermore, the legs 105 are configured to be supported by the edge of the front cover 2*a* when rotated 90° as in FIG. 9C, providing for a structure which makes the legs 105 more stable. While in the example shown here, a pair of legs 105 were provided at the two widthwise ends of the tray 11, the number of legs can also be three or more, or a single leg spanning a prescribed region in the widthwise direction of the tray 11 may also be used.

In some aspects, the legs 105 can be fashioned to be foldable and to be housed in the device main body 1*a* when not being used, allowing the device to be made more compact.

The legs 105 are provided with a rolling member 107 capable of rolling in the position where it contacts the installation surface F. Through the support of the legs 105, the tray 11 is supported in a horizontal state over the installation surface F via the legs 105. An arrangement which allows the tray to be supported in a horizontal state in this manner allows the tray 11 to be handled more easily and stably, since there is no need to tilt the tray 11. Of course, this arrangement can also prevent overturning of the device main body.

Figure 10A:
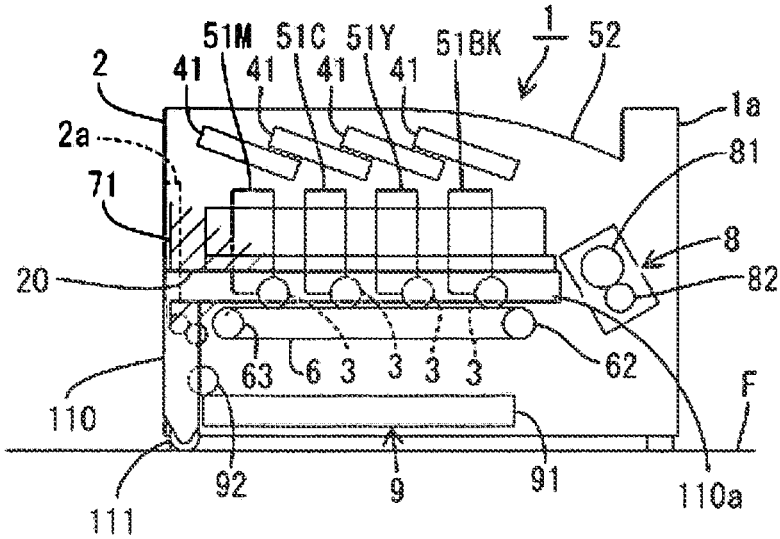
FIG. 10A illustrates a lateral cross-section of another color laser printer according to at least one aspect of the invention.

FIG. 10A is a lateral cross-section schematically illustrating the color laser printer according to aspects of the invention. FIGS. 3B and C are illustrations explaining how the tray is pulled out of the color laser printer of FIG. 10A.

In some aspects the tray 11 can be supported indirectly by another member, wherein, similarly to FIG. 9A, legs 110 can be provided to support the second support part of the tray 11 (the part supported by the legs 110) pulled out from the device main body 1*a* when the legs contact the installation surface F.

Figure 10B:
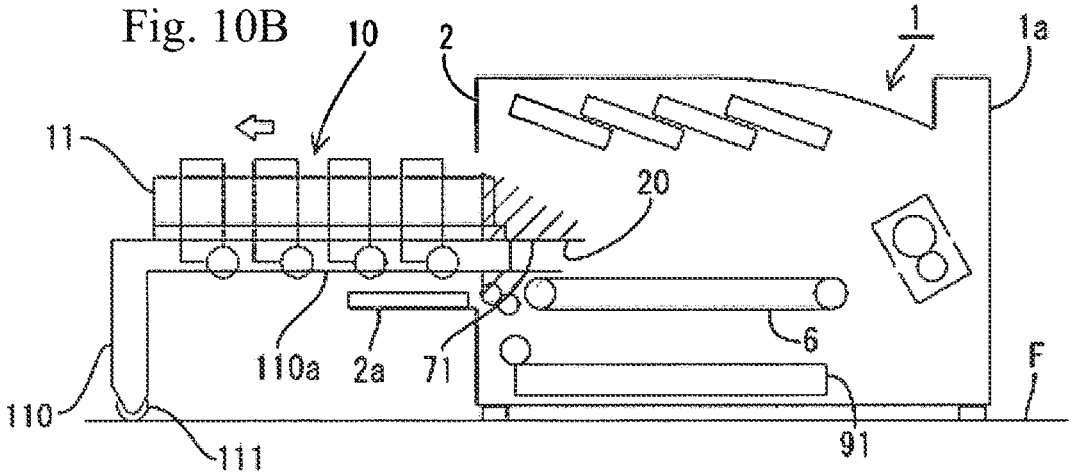
FIGS. 10B and C illustrate another process of pulling out a tray according to at least one aspect of the invention.
Figure 10C:
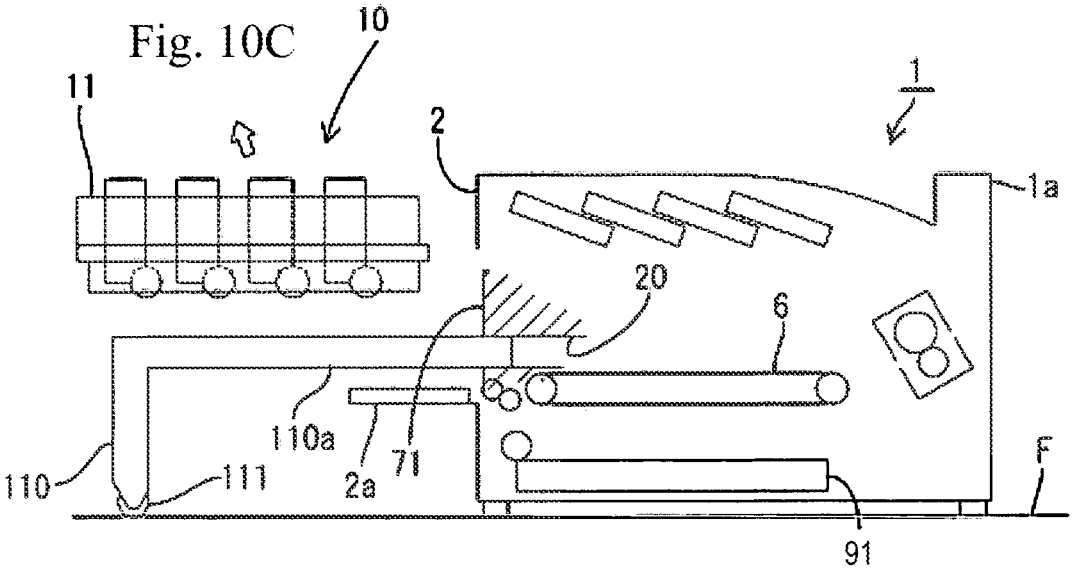

The legs 110 can be fashioned integrally with the tray 11 so as to extend downward from the tray 11. Furthermore, the legs 110 can be provided with a rolling member 111 capable of rolling in the position where it contacts the installation surface F. Furthermore, the tray 11 can be supported in a horizontal state over the installation surface F by the legs 110. Moreover, as shown in FIG. 10C, the tray 11 can be configured such that it can be removed from the device main body 1*a* (specifically, with the developing units 51M, 51C, 51Y, and 51BK loaded in the tray).

In some aspects, the legs 110 can be provided in a pair, one at each widthwise end of the tray 11 (in FIG. 10A through C, only the near side leg 110 is shown), and the legs 110 support the tray 11 while maintaining its balance in the widthwise direction. Furthermore, in the case of FIG. 10, the legs 110 can be arranged at the two sides in the widthwise direction of the front cover 2*a* arranged to be opened and closed at a position in front of the tray 11, and include an extension 110*a* which extends upstream in the pull-out direction. This extension 110*a* is designed to retain the tray 11 and to move in and out of the device main body 1*a* at the side of the front cover 2*a*. When the front cover 2*a* is open, the area in front of the tray 11 is opened up and the legs 110 and tray 11 can be integrally pulled out, as shown in FIG. 10B. The extension 110*a* and the tray 11 are made detachable, and pulling out the tray 11 as shown in FIG. 10C allows it be completely detached, as discussed above.

While in the example shown here the legs 110 and the front cover 2*a* were fashioned separately, it is also possible to configure a portion of the component constituting the legs 110 as the front cover. Furthermore, while in the example shown here, a pair of legs 110 was provided at the two widthwise ends of the tray 11, the number of legs can also be three or more, or a single leg spanning a prescribed region in the widthwise direction of the tray 11 may also be used.

FIG. 11A is a lateral cross-section schematically illustrating the color laser printer according to aspects of the invention. FIGS. 3B and C are illustrations explaining how the tray is pulled out from the color laser printer in FIG. 11A.

Aspects involve a partial modification of FIG. 10. Specifically, the legs 114, which have substantially the same configuration as legs 110 of FIG. 10, are fashioned as separate components from the tray 11, and are mounted detachably on the tray 11. This arrangement makes it possible to remove the legs 114 if required, allowing them to be used as appropriate for the circumstances.

The legs 114 can be provided in a pair, mounted at positions at the two widthwise ends of the tray 11 (more specifically, at positions outward from the front cover 2*a* in the widthwise direction) (in FIGS. 11A through C, only the near side leg 110 is shown) The legs are designed to support the tray 11 while maintaining its balance in the widthwise direction. In the example of FIG. 11, a space for inserting the legs 114 (not shown) is provided at the sides of the front cover 2*a*. This space can be made to be opened and closed by a separate component from the front cover 2*a*, or can be always left open if the space is small. Furthermore, in some aspects, a rolling member 115 can be provided below the legs 114. While here a pair of legs 110 was provided at the two widthwise ends of the tray 11, the number of legs can also be three or more, or a single leg spanning a prescribed region in the widthwise direction of the tray 11 may also be used.

In FIG. 12, a support mechanism 140 can be provided to be relatively displaceable with respect to the device main body 1*a* independently of the tray 11. In some aspects, the mechanism for displacing the tray 11 is made separate from the mechanism for displacing the downstream supporting part (i.e. the mechanism for displacing the support mechanism 140). Doing so allows the mechanisms for displacing the individual components to be fashioned with a greater degree of freedom.

The support mechanism 140 can be configured to be foldable and to be housed in the device main body 1*a* in the folded state. More specifically, a portion of the support mechanism 140 doubles as the front cover 2*a*, and the support mechanism 140 can be fashioned such that the frames 140*a* and 140*b* and the supporting part 140*e* spring upward when the front cover 2*a* is lowered, as shown in FIG. 12B. The frames 140*a* and 140*b* and the supporting part 140*e* are provided in a pair to support the widthwise ends of the tray 11 and are fashioned to support the tray 11 while maintaining its balance in the widthwise direction. In the example of FIG. 12, only the near side frames 140*a* and 140*b* and supporting part 140*e* are illustrated.

The frames 140*a* and 140*b* of the support mechanism 140 are impelled by spring members 140*c* and 104*d*, and in the supporting state, the supporting part 140*e* which receives the tray 11 is maintained in an impelled state where it is pushed upward, as shown in FIG. 12B and C. In this state, when the tray 11 is pulled out, the tray 11 becomes supported in a horizontal state above the installation surface F as shown in FIG. 12C. Furthermore, when the frames 140*a* and 140*b* and the supporting part 140*e* are folded against the impelling force of the spring members 140*c* and 140*d* and the front cover 2*a* is closed, the support mechanism 140 becomes housed inside the device main body 1*a*, as shown in FIG. 12A. Although not illustrated in FIG. 12, a rolling member may also be provided at the upper end of the support mechanism 140.

Aspects of the present invention are not limited to those explained in the above descriptions and drawings. For example, the following aspects are also included within the technical scope of the present invention, and other aspects beside those indicated below are also possible.

(1) In the above-described aspects, the image forming device can be a printing device other than a color laser printer a facsimile machine, a combination device with a printer function and scanner function, or the like.

(2) The recording medium is not limited to paper or paper based recording media, and can be for instance a plastic recording medium such as OHP sheets.

Figure 13A:
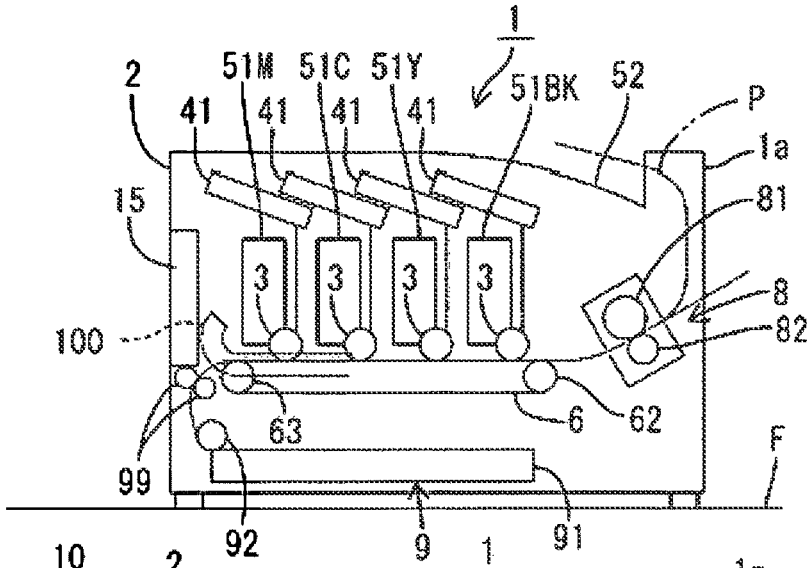
FIG. 13 illustrates an application of a tray with a front cover according to at least one aspect of the invention.
Figure 13B:
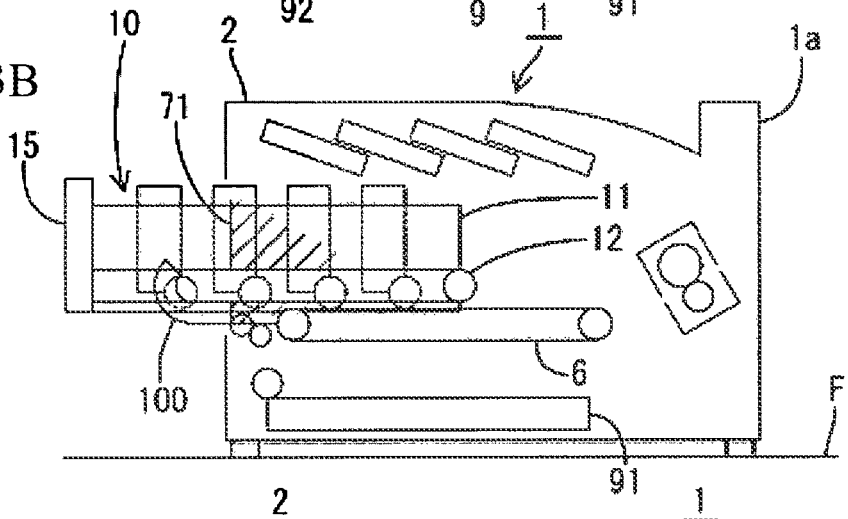
Figure 13C:
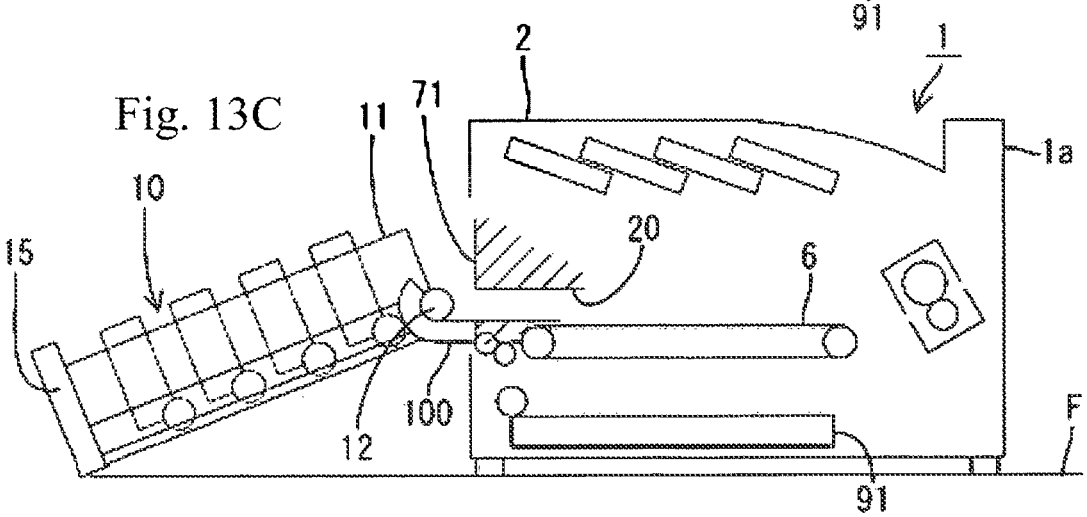

(3) In the above-described aspects, a tray into which a development apparatus is placed was illustrated, but the tray is not limited to this configuration as long as the tray can be pulled out above the housing element which houses the recording medium. For example, can also be applied to a tray with a front cover, as illustrated in FIG. 13 (i.e. an arrangement wherein a portion of the tray functions as the front cover 15). FIG. 13A is a lateral cross-section schematically illustrating an example in which aspects of the present invention are applied to a tray with a front cover. FIGS. 13 B and C are illustrations explaining how the tray is pulled out in this configuration. Furthermore, aspects can be applied to a tray which holds a belt unit, as shown in FIG. 14. Furthermore, aspects of the invention are not limited to these arrangements, and the tray can hold components other than a developer apparatus.

The invention claimed is:

1. An image forming device comprising:

a main body having an opening;

a tray configured to hold a plurality of developing units arranged in a first direction;

a support coupled to the main body; and a cover coupled to the main body and different from the support, the cover configured to be moved between a closed position where the cover closes the opening and an open position where the cover opens the opening, the cover being moved independent of the tray, wherein the support is configured to guide the tray in the first direction, the support is movable in the first direction between a first position inside the main body and a second position outside the main body, the support is positioned at the first position inside the main body when the cover is at the closed position, and the support is positioned at the second position protruding outside the main body in the first direction when the cover is at the open position, wherein the support moves between the first position inside the main body and the second position outside the main body as the cover moves between the closed position and the open position, and wherein the tray is movable through the opening while being guided by the support when the cover is positioned at the open position.

2. The image forming device according to claim 1, wherein, when the support is positioned at the first position, the support is retracted inside the main body.

3. The image forming device according to claim 1, wherein the support includes a pair of separate support elements.

4. The image forming device according to claim 1, wherein the support includes an end portion, and when the tray is located outside the main body, the end portion supports an upstream end of the tray in a direction of movement of the tray to outside of the main body from inside of the main body.

5. The image forming device according to claim 1, further comprising a spring member configured to move the support.

6. The image forming device according to claim 1, wherein the support is configured to guide the tray such that the plurality of developing units held by the tray moves to outside the main body in the first direction.

7. The image forming device according to claim 1, further comprising a cassette configured to hold a recording medium and to be housed inside the main body, wherein the tray is disposed above the cassette.

8. The image forming device according to claim 1, wherein the support moves between the first position inside the main body and the second position outside the main body along a substantially straight line as the cover moves between the closed position and the open position, and wherein the tray is movable through the opening along the substantially straight line while being guided by the support when the cover is positioned at the open position.

9. An image forming device comprising:

a main body having an opening;

a tray configured to hold a developing unit;

a support coupled to the main body and configured to guide the tray, the support being movable between a first position inside the main body and a second position outside the main body; and a cover coupled to the main body and different from the support, the cover configured to be moved between a closed position where the cover closes the opening and an open position where the cover opens the opening, the cover being moved independent of the tray; and wherein the support is positioned at the first position inside the main body when the cover is at the closed position, wherein the support is configured to be moved from the first position inside the main body to the second position protruding outside the main body when the cover is at the open position, wherein the support moves between the first position inside the main body and the second position outside the main body as the cover moves between the closed position and the open position, and wherein the tray is movable through the opening while being guided by the support when the cover is positioned at the open position and the support has been moved to the second position.

10. The image forming device according to claim 9, wherein, when the support is positioned at the first position, the support is retracted inside the main body.

11. The image forming device according to claim 9, wherein the support includes a pair of separate support elements.

12. The image forming device according to claim 9, wherein the support includes an end portion, and when the tray is located outside the main body, the end portion supports an upstream end of the tray in a direction of movement of the tray to outside of the main body from inside the main body.

13. The image forming device according to claim 9, further comprising a spring member configured to move the support.

14. The image forming device according to claim 9, wherein the tray is configured to hold a plurality of developing units along a line, and wherein the support is configured to guide the tray such that the plurality of developing units held by the tray moves to outside the main body along the line.

15. The image forming device according to claim 9, further comprising a cassette configured to hold a recording medium and to be housed inside the main body, wherein the tray is disposed above the cassette.

16. The image forming device according to claim 9, wherein the support moves between the first position inside the main body and the second position outside the main body along a substantially straight line as the cover moves between the closed position and the open position, and wherein the tray is movable through the opening along the substantially straight line while being guided by the support when the cover is positioned at the open position.

17. An image forming device comprising:

a main body having an opening;

a tray configured to hold a plurality of developing units arranged in a first direction;

a support coupled to the main body;

a cover coupled to the main body and different from the support, the cover configured to be moved between a closed position where the cover closes the opening and an open position where the cover opens the opening, the cover being moved independent of the tray; and a spring provided in the main body, wherein the support is movable in the first direction between a first position and a second position, wherein the support is configured to guide the tray in the first direction as the support moves from the first position to the second position, wherein the spring is configured to move the support in the first direction from the first position to the second position as the cover moves from the closed position to the open position, wherein the spring is configured to push the support toward the second position, wherein the support is positioned at the first position when the cover is at the closed position, wherein the support is positioned at the second position when the cover is at the open position, and wherein the tray is movable through the opening while being guided by the support when the cover is positioned at the open position.

* * * * *